US007721748B2

(12) United States Patent
Dreamwalker

(10) Patent No.: US 7,721,748 B2
(45) Date of Patent: May 25, 2010

(54) POLE BRACE AND BALLASTING DEVICE

(76) Inventor: Richard Dreamwalker, P.O. Box 941, Rapid City, SD (US) 57709

( * ) Notice: Subject to any disclaimer, the term of this patent is extended or adjusted under 35 U.S.C. 154(b) by 351 days.

(21) Appl. No.: 11/900,130

(22) Filed: Sep. 10, 2007

(65) Prior Publication Data

US 2009/0301535 A1 Dec. 10, 2009

Related U.S. Application Data

(63) Continuation-in-part of application No. 11/699,050, filed on Jan. 29, 2007, now abandoned.

(51) Int. Cl.
*E04H 15/60* (2006.01)

(52) U.S. Cl. ..... 135/114; 135/120.1

(58) Field of Classification Search ..... None
See application file for complete search history.

(56) References Cited

U.S. PATENT DOCUMENTS 3,894,707 A * 7/1975 Heard ..... 248/230.9
5,020,764 A * 6/1991 Yamamoto ..... 248/529
5,112,023 A 5/1992 Sowers
5,158,281 A * 10/1992 Williams ..... 473/483
5,178,356 A 1/1993 Schouwey
5,737,883 A * 4/1998 Rose ..... 52/169.9
5,979,844 A 11/1999 Hopkins
6,164,613 A * 12/2000 Williams ..... 248/533
6,267,461 B1 * 7/2001 Dunagan et al. ..... 312/49
6,269,825 B1 8/2001 Yager
6,981,680 B1 * 1/2006 Gordon et al. ..... 248/346.01
7,179,010 B2 * 2/2007 Weger et al. ..... 403/289
7,213,869 B1 * 5/2007 McClellan ..... 296/161

* cited by examiner

*Primary Examiner*—David Dunn
*Assistant Examiner*—Noah Chandler Hawk

(57) ABSTRACT

A pole brace and ballasting device having at least one or more releasably connecting weight containers adapted to retain and discharge a dry or fluid load bearing material therein of adequate length and sufficiently ridged to brace a pole. A hand activated clamp or clamps for attachment to a variety of pole dimensions both angular and round, while allowing for the closing of the tent's outer protective cover; with the capacity to selectively suspend the ballasting load to prevent it from coming at rest with the ground for an increase in its effectiveness.

19 Claims, 9 Drawing Sheets

POLE BRACE AND BALLASTING DEVICE

CROSS-REFERENCE TO RELATED APPLICATIONS

This application is a continuation-in-part claiming the benefit to non-provisional application Ser. No. 11/699,050 filed on Jan. 29, 2007 now abandoned.

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

Staying fixed to the ground during inclement weather is a challenge for anyone using a portable shade canopy, display stand or tent typically used at farmers markets, craft shows or outdoor events. Strong unexpected gusts of wind can come up anywhere in the United States and turn a shade canopy into a deadly missile. In cases where the event is held on a paved surface, driving an anchor pile into the ground is often not possible or permitted; and many of the devices in use today for securing a tent or shade canopy are inadequate or pose an additional hazard.

In addition to the objectives set forth in pending application Ser. No. 11/699,050 filed on Jan. 29, 2007, is the provision of an improved pole brace and ballasting device which includes a handle or handles formed or attached to the weight container to facilitate the carrying of the weight.

A further objective of the present invention is the provision of an improved pole brace and ballasting device wherein the weight container is adapted for readily and reliably connecting one or more weight containers for a substantial increase in the ballasting load. This allows for the division of the ballasting load into a more manageable size and facilitates the transportation and installation of the device.

Yet another objective of the present invention is the provision of an improved pole brace and ballasting device wherein the removable cover of the weight container, acting as a joining mechanism, engaged to a weight container corresponding interface, is adapted for easy hand removal in the event it becomes attached or lodged to the weight container after separation of the weight containers.

A further objective of the present invention is the provision of an improved pole brace and ballasting device wherein the cover and corresponding weight container interface to the cover are synchronized to allow for the automatic vertical alignment, when attaching a secondary weight container, of the pole clamp connecting form disposed along the wall or walls of the weight container upon reasonably reaching the rotatable limit of the connecting interface.

Another objective of the present invention is the provision of an improved pole brace and ballasting device comprising a pole clamp which utilizes an embedded threaded collar or threaded aperture in at least one of two clamp blocks of the pole clamp assembly, simplifying the insertion and tightening of the securing fastener.

Another objective of the present invention is the provision of an improved pole brace and ballasting device comprising a pole clamp which includes a thumb screw for tightening of the pole clamp to the pole precluding the use of a screwdriver.

A further objective of the present invention is the provision of an improved pole brace and ballasting device comprising a pole clamp which is fitted with a fastener for the fortification of the clamp block outer jaw.

Yet another objective of the present invention is the provision of a pole brace and ballasting device with an improved pole clamp for better gripping a round pole.

A further objective of the present invention is the provision of an improved pole brace and ballasting device which allows for the utilization of a variety of weight container configurations.

REFERENCE CITED

U.S. Pat. No. 6,981,680/January 2006 Gordon
U.S. Pat. No. 5,020,764/June 1991/Yamamoto
U.S. Pat. No. 6,269,825/August 2001/Yager
U.S. Pat. No. 5,979,844/November 1991/Hopkins
U.S. Pat. No. 5,178,356/January 1993/Schouwey
U.S. Pat. No. 5,112,023/May 1992/Sowers

SUMMARY

The present invention assists an outdoor exhibitor or consumer with a shade canopy or pole using tent during windy or inclement weather by providing a stabilizing force, decreasing the probability of the tent from blowing away or tipping over, by clamping the device vertically to a tent pole. An adjustable tent pole clamp system, capable of attaching to a round or square pole, is provided that will not interfere with the closing of tent's outer protective cover. One or more leak proof containers, for retaining a load bearing material, of a sufficiently rigid and elongated compact design are capable of forming a brace when attached between two elements of a telescoping pole. Multiple weight containers may be secured together by means of a cover adapted to engage a corresponding interface disposed along the bottom wall of the weight container. The weight container is provided with a tap to receive and discharge a fluidic or dry ballasting load therein and a handle to facilitate the transportation and installation of the device.

These and other aspects and advantages of the present invention will become better understood with reference to the following description and claims.

BRIEF DESCRIPTION OF THE DRAWINGS

For the purpose of illustrating the invention, there is shown in the drawings a form which is presently preferred; it being understood, however, that this invention is not limited to the precise materials, arrangements and instrumentalities shown.

KEY TO DRAWINGS

Figure 1:
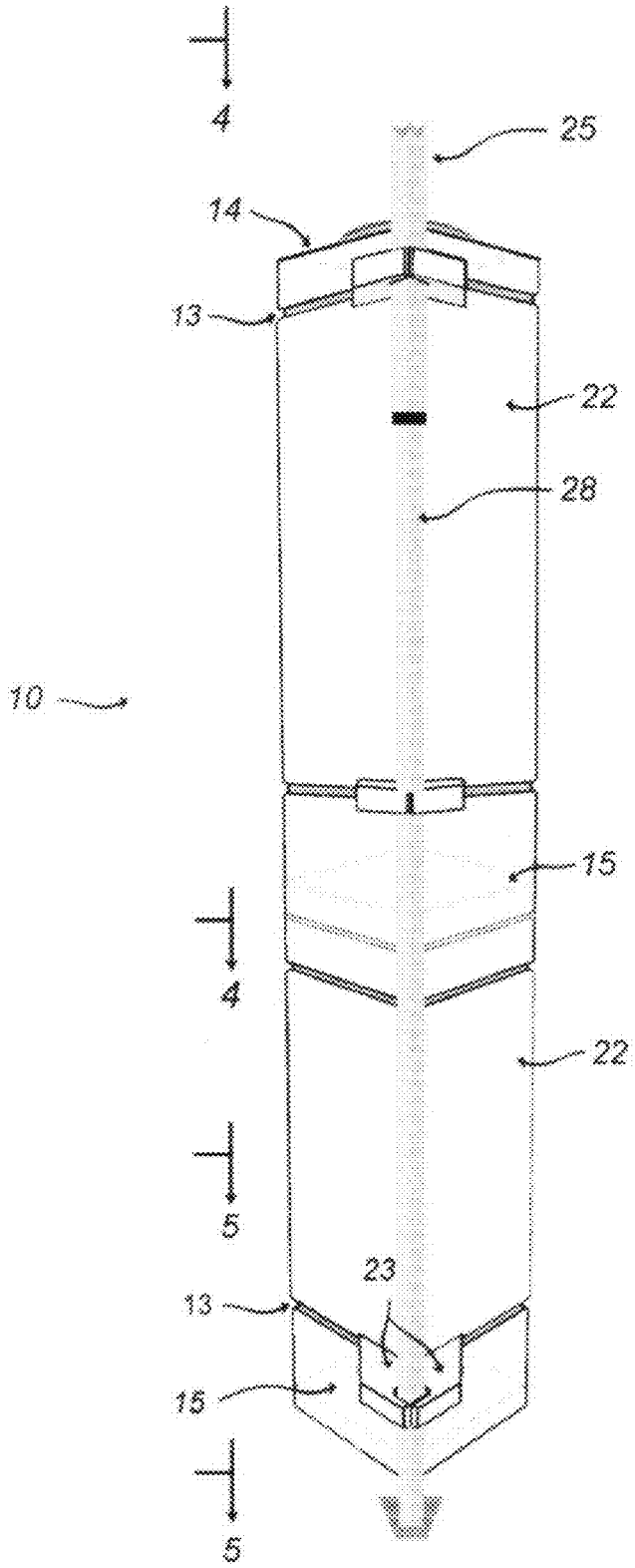
FIG. 1 is a perspective view of the present invention attached to a telescoping pole.

10 pole brace and ballasting device
11 pole clamp block
12 fastener for drawing clamp blocks against a pole
13 pole clamp weight container connecting form
14 top wall of weight container 22
15 bottom wall of weight container 22
16 threaded collar opening for charging and discharging a fluidic or dry ballasting load
17 cover for opening 16
18 common aperture for receiving fastener 12
19 pole clamp block jaw
20 connecting form for engaging clamp block with the corresponding connecting form 13 of weight container 22
21 embedded threaded collar.
22 weight container
23 pole clamp assembly
24 slip resistant surface
25 upper tent pole element of a telescoping pole
26 tent
27 cutout in weight container 22
28 lower tent pole element of a telescoping pole
29 tent pole
30 handle
31 outer jaw of pole clamp block 11
32 tent canopy
33 inner jaw of pole clamp block 11
34 horizontal pole through hole
35 round pole
36 fastener for fortifying pole clamp block outer jaw 31
37 slip resistant surface
38 external threads of cover 17 for connecting to a secondary weight container
39 internal threads of cover 17 for connecting cover to weight container 22
40 projection of cover 17
41 collar for connecting a secondary weight container 22
42 inner connecting threads of weight container collar 41
43 straight pole clamp connecting form
44 semicirclar round pole interface
45 flat square pole interface
46 perpendicular collar slot of bayonet mount collar 54
47 second pole clamp block
48 triangular shaped weight container
49 second pole clamp block jaw
50 second inner jaw
51 second outer jaw
52 second pole clamp assembly
53 bayonet mount cover
54 bayonet mount collar of weight container 55
55 weight container
56 cover pins
57 collar slots
58 bottom wall of weight container 55

DESCRIPTION OF THE PREFERRED EMBODIMENT

Referring now to the drawings, by way of illustration and not by limitation, wherein like numerals indicate like elements there is in FIG. 1 a pole brace and ballasting device 10 shown with two connecting weight containers 22 in accordance with the present invention and claiming the benefit to pending non-provisional application Ser. No. 11/699,050 filed on Jan. 29, 2007.

Figure 2:
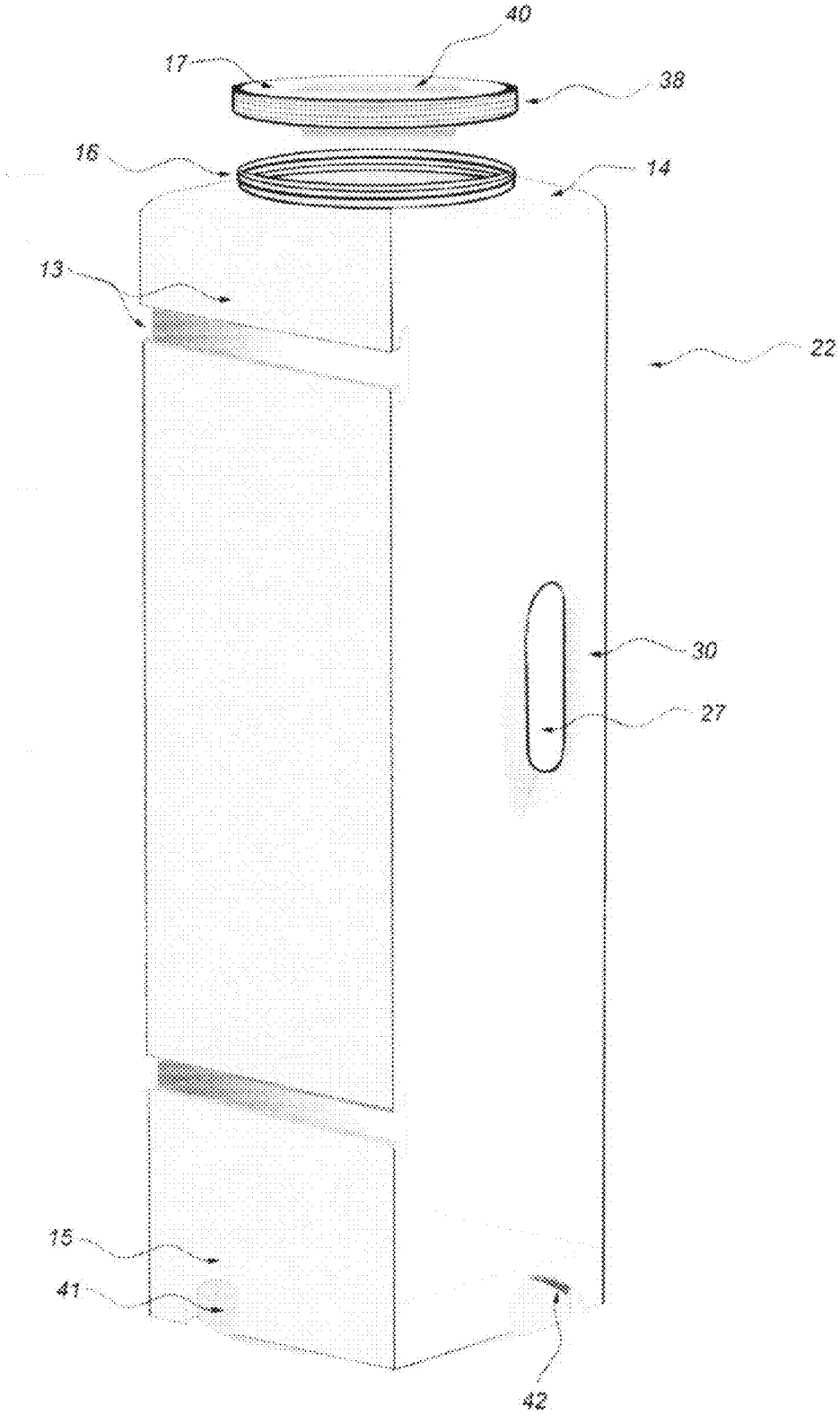
FIG. 2 is a side perspective view of the weight container 22.
Figure 7:
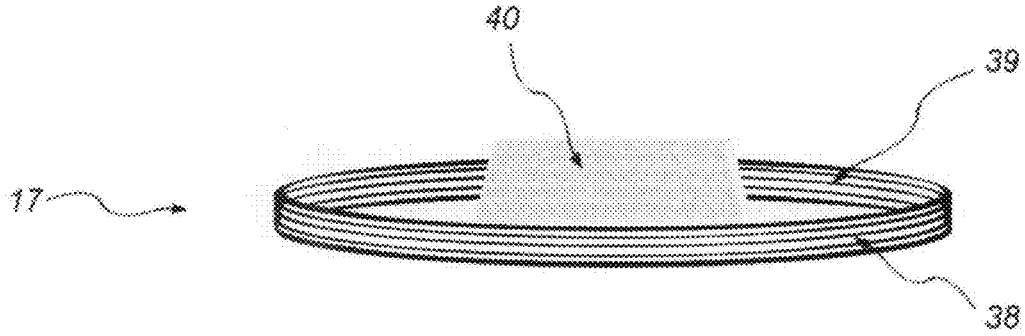
FIG. 7 is a side elevation view of inverted cover 17.

Referring to FIGS. 2 and 7, threaded collar 16 located at the central portion of the top wall 14 of weight container 22 can be tightly closed by applying, internally threaded 39 and externally threaded 38, cover 17 and rotating it clockwise for selectively charging and discharging a dry or fluid load bearing material therein. Weight container 22 is provided with cut out portion 27 across which handle 30 is formed to facilitate the transportation and storage of weight container 22.

Weight container 22 is fitted with collar 41 disposed along its bottom wall 15 and inner connecting threads 42 forming a corresponding connecting interface to cover 17 by rotating a secondary weight container 22 clockwise, engaging external threads 38 of cover 17, for a releasably secure connection of a secondary weight container ensuring the pole bracing effect of device 10. External threads 38 of cover 17 and corresponding weight container inner connecting threads 42 are synchronized to allow for the automatic vertical alignment of the pole clamp connecting forms 13, (Best seen in FIG. 1) when attaching a secondary weight container, upon reasonably reaching the rotatable limit of external threads 38 and inner connecting threads 42. The synchronization of weight container 22 connecting interface insures that the weight container wall or walls having one or more connecting form 13, or connecting form 43 according to the second embodiment described below, will quickly align to the pole facilitating the installation of pole brace and ballasting device 10. The connecting interface could be reversed so that cover 17 has an inward extending threaded depression and weight container 22 an outward threaded collar achieving the same results; or the threads could be substituted with a bayonet mount connecting interface similar to the one contained in the third embodiment described below.

The ability to attach one or more weight containers permits the ballasting load to be divided into a more manageable size facilitating its transportation while allowing for a substantial increase in weight when needed.

As depicted in FIGS. 2 and 7, projection 40 of cover 17 is provided to facilitate the removal of cover 17 from collar 41 of a secondary weight container 22 in the event it becomes attached or lodged after separation of the weight containers as the cover will be in an inverted position allowing for easy hand removal or through the use of a hand tool such as an adjustable wrench.

Figure 3:
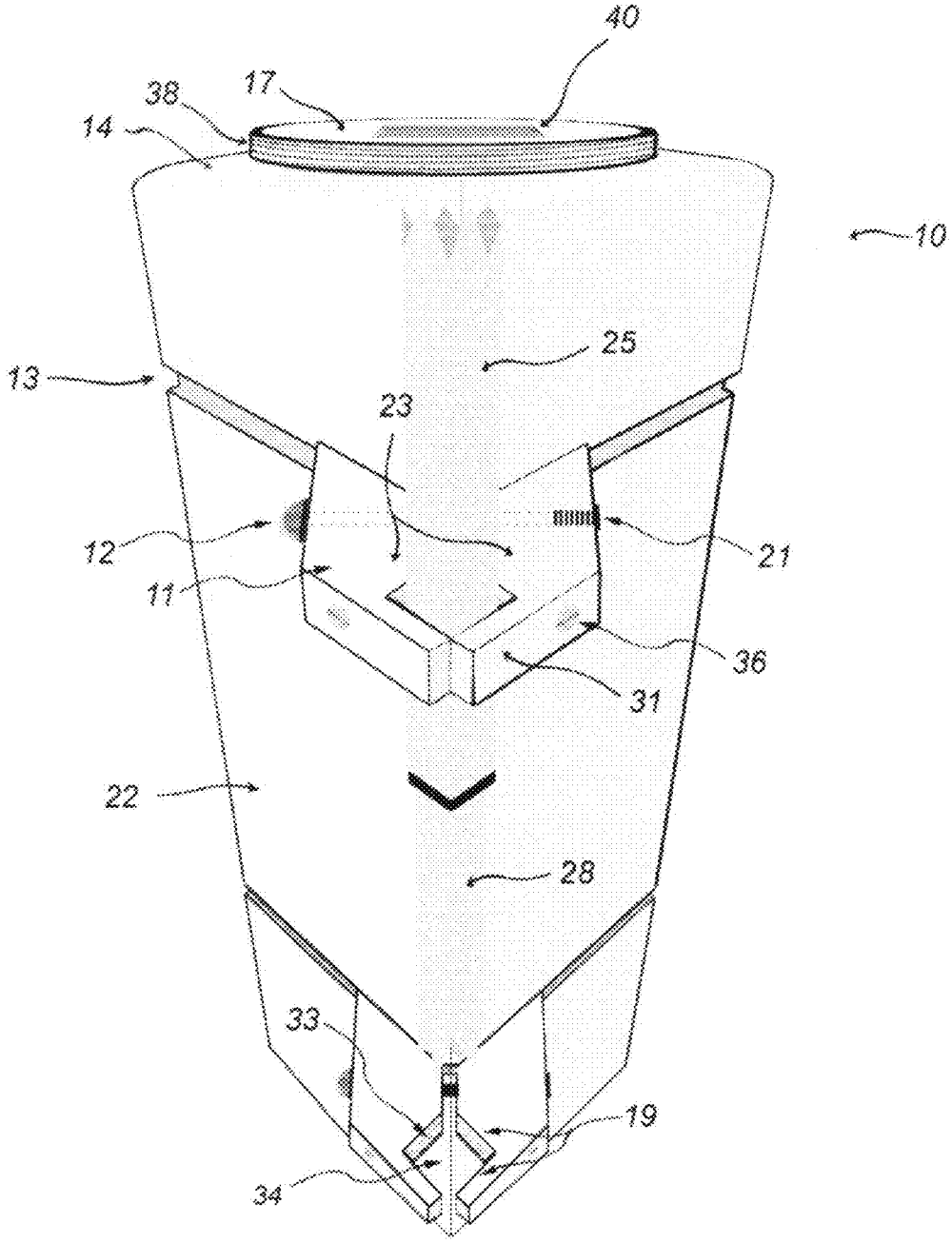
FIG. 3 is a sectional view of the assembled pole brace and ballasting device taken along the lines 4-4 in FIG. 1.
Figure 4:
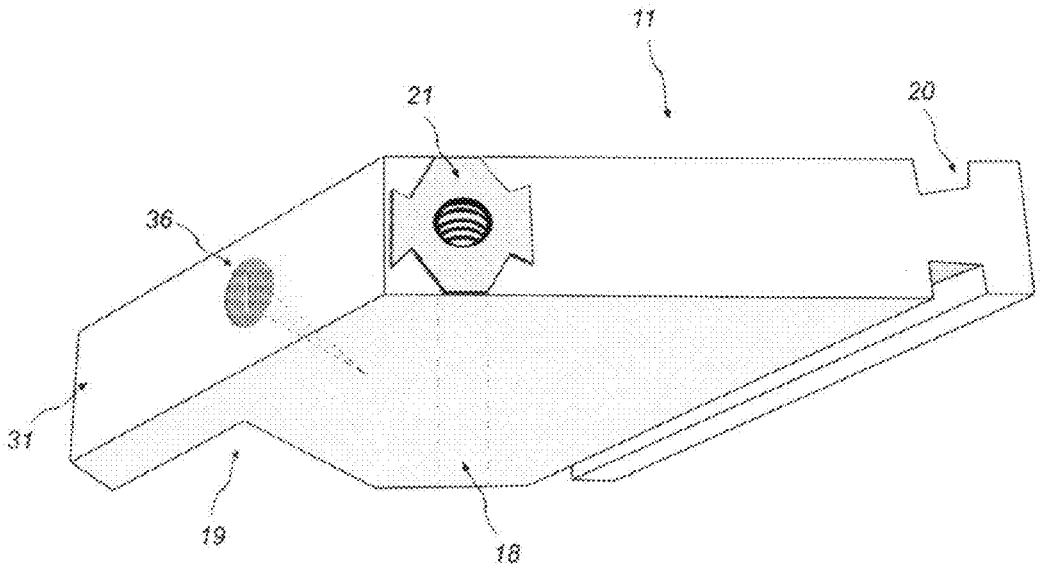
FIG. 4 is a side elevation views of clamp block 11.
Figure 4:
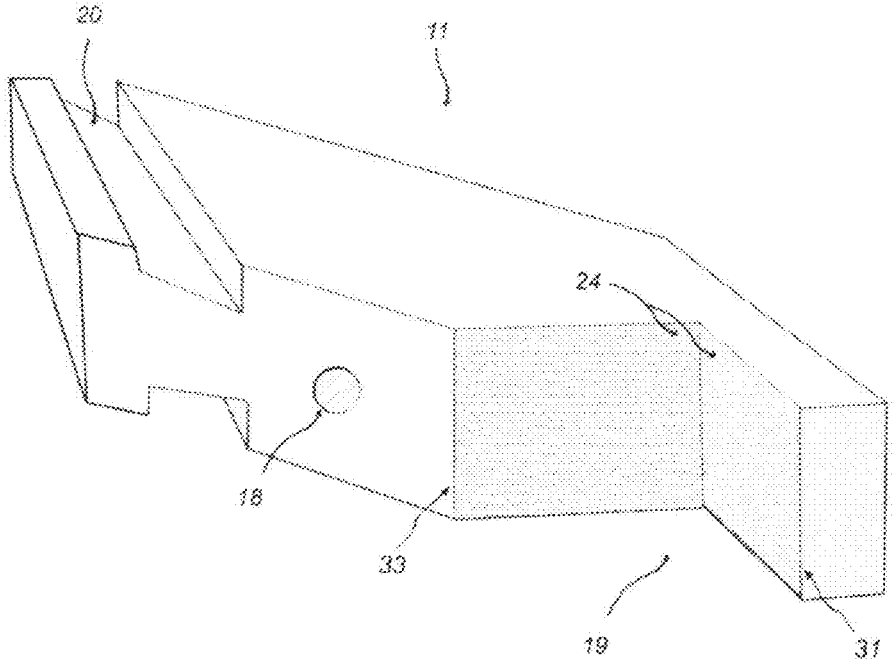
Figure 5:
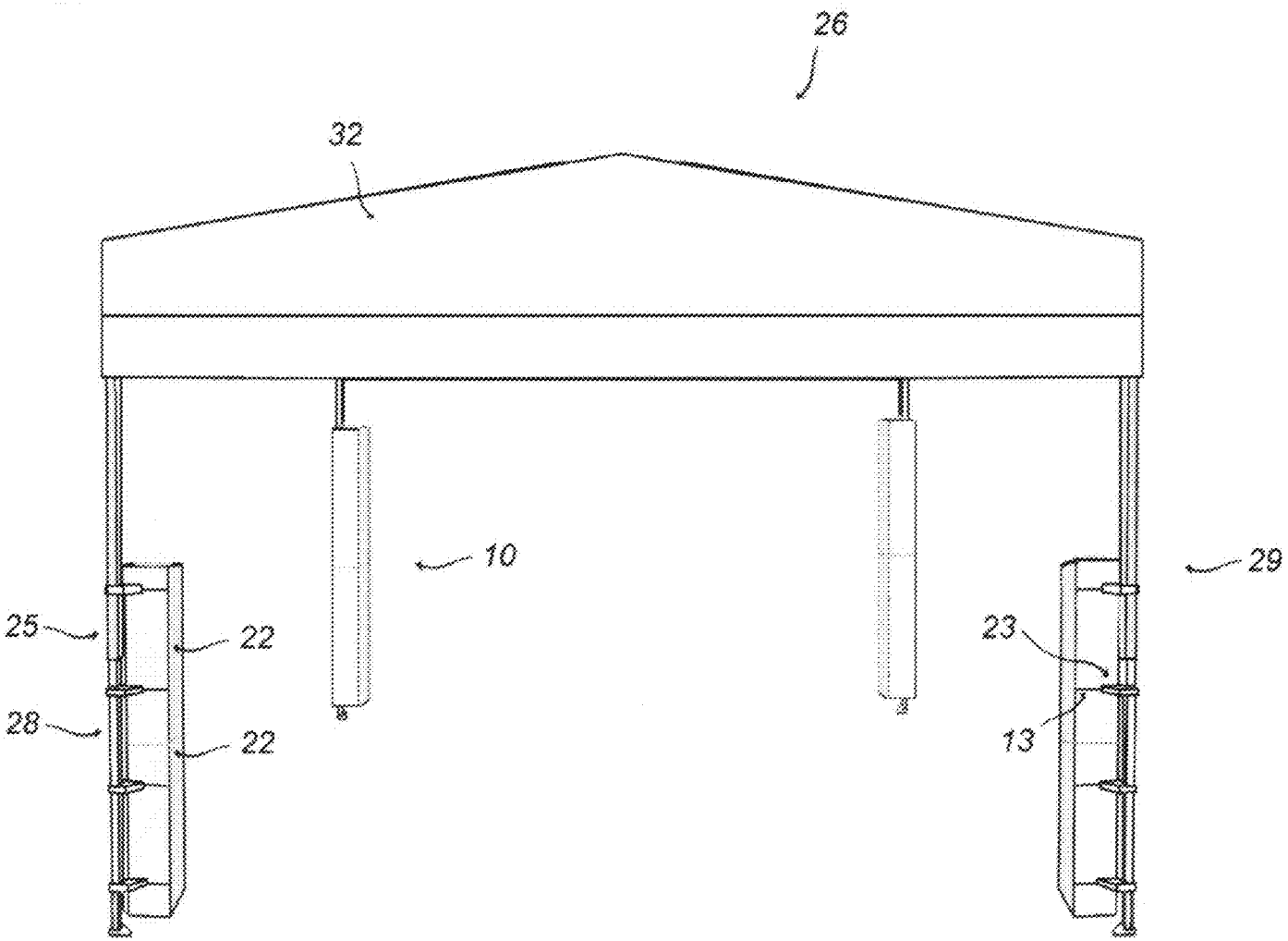
FIG. 5 is a schematic view illustrating the pole brace and ballasting device in FIG. 1 used for supporting tent poles.

Shown in FIG. 3, is pole clamp assembly 23 containing a right and corresponding left pole clamp block 11. Pole clamp connecting form 13, which can be molded into or attached to weight container 22, having a right angle bend is set in a perpendicular direction of tent pole elements 25 and 28 in two exterior walls of weight container 22. Pole clamp block 11 is operatively connected to pole clamp form 13 by connecting form 20 (Best seen in FIG. 4); it being understood that many other configurations for connecting form 20 of pole clamp block 11 and corresponding pole clamp connecting form 13 of weight container 22 may be utilized such as a dovetail without departing from the scope of the invention. Additionally, the connecting forms depicted could be reversed so that pole clamp connecting form 13 of weight container 22 is substituted for connecting form 20 of clamp block 11 and vice-versa.

Upon engaging pole clamp connecting form 13, pole clamp block 11 is movable toward and away from stationary tent pole 29 permitting the enlargement or reduction of the horizontal pole through hole 34. This operative connection allows for the attachment to a variety of pole 29 dimensions.

Referring again to FIGS. 3 and 4, pole clamp block 11 is fitted with embedded threaded collar 21 in common aperture 18 of one of two pole clamp blocks 11 and fastener 36, when pole clamp block 11 is constructed of wood, for the fortification of pole clamp block outer jaw 31 which pole clamp block jaw 19 is partially formed. However, the use of fastener 36 and embedded threaded collar 21 could be precluded by constructing the pole clamp block from a metallic or plastic matter of sufficient strength to prevent the possible separation of pole clamp block outer jaw 31, while clamping to a pole, and allowing the threading of common aperture 18 to engage fastener 12 for drawing the right and corresponding left pole clamp blocks 11 against a pole or pole elements 25 and 28.

Figure 6:
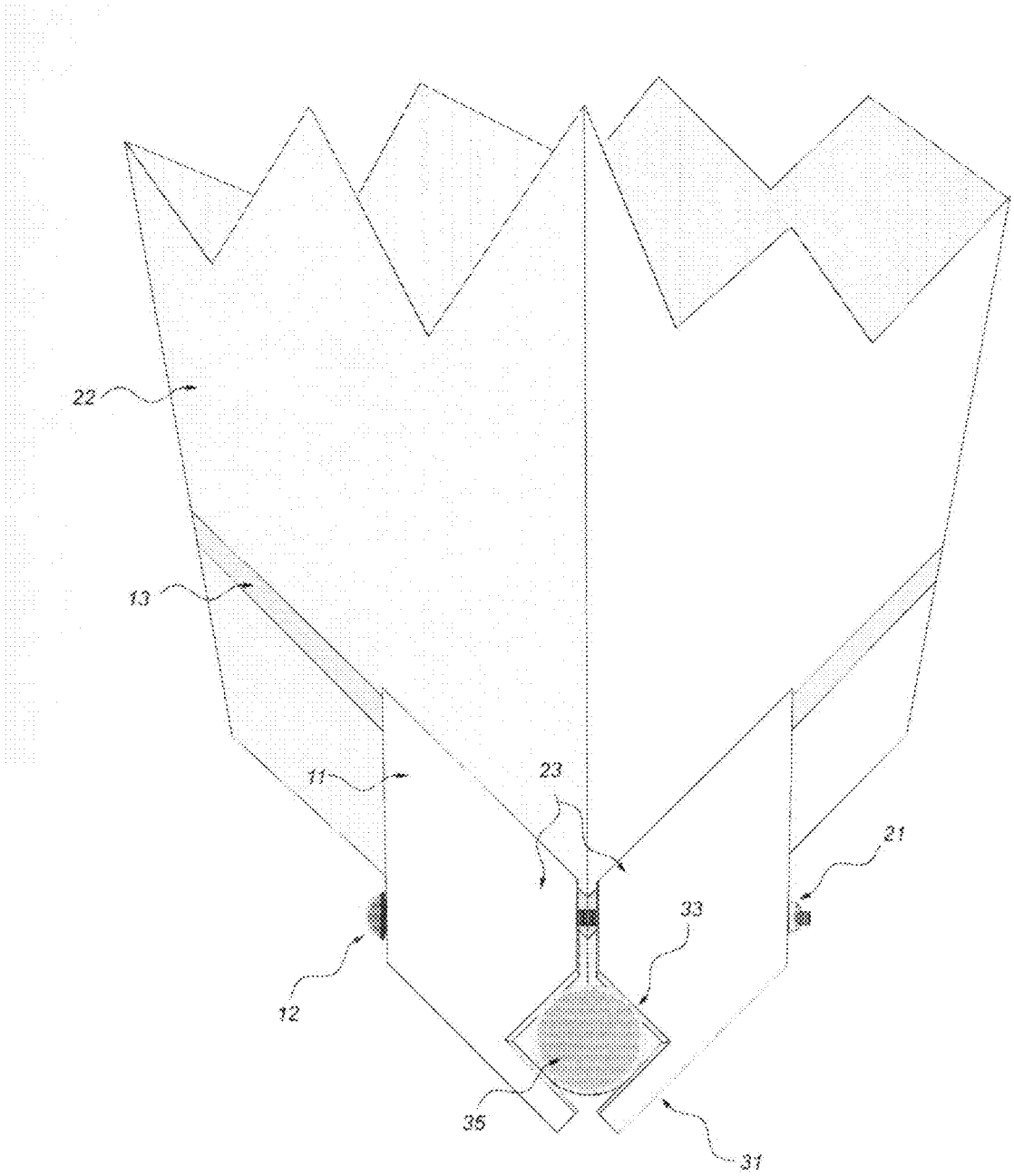
FIG. 6 is a sectional top view of the pole brace and ballasting device attached to a round pole taken along the lines 5-5 in FIG. 1.

Referring again to FIG. 3, after adjusting said discrete pole clamp blocks 11 relative to each other along pole clamp connecting form 13, the inner jaw 33 and outer jaw 31 of pole clamp block 11 and slip resistant surface 24 (Seen in FIG. 4), preferable rubberized or scored, are brought to bear against the pole and a properly sized square horizontal pole through hole 34 is formed. Inserting fastener 12, being of sufficient length to engage two discrete pole clamp blocks 11, into common aperture 18 and engaging embedded threaded collar 21 and preferably tightening by hand through the use of a thumb screw, draws the right and corresponding left clamp blocks 11 together thereby tightly gripping the pole. Further, upon engagement of each said discrete pole clamp block 11 to the pole clamp connecting form 13 of weight container 22, the inner gripping surface of clamp jaw 19 of each pole clamp block 11 will automatically position in a vertical dimension relative to the direction of the pole, engaging the gripping surface to the pole surface, and outer jaw 31 of clamp block 11 will automatically position about at a right angle to the outer jaw of its corresponding pole clamp block when in an assembled condition; and inner jaw 33 will automatically position about at a right angle to the inner jaw of its corresponding pole clamp block when in an assembled condition. Being so arranged permits the pole clamp assembly 23 to readily secure to a round pole 35 (Seen in FIG. 6) or square pole 29.

Pole brace and ballasting device 10, in FIG. 1, is depicted utilizing two weight containers 22, constructed from a sufficiently rigid and water proof material of compact design and length to form a brace when attached between tent pole elements 25 and 28. Additionally, weight container 22 is of sufficient length as to form a brace if pole brace and ballasting device 10 is use in a singularly weight container configuration.

Figure 8:
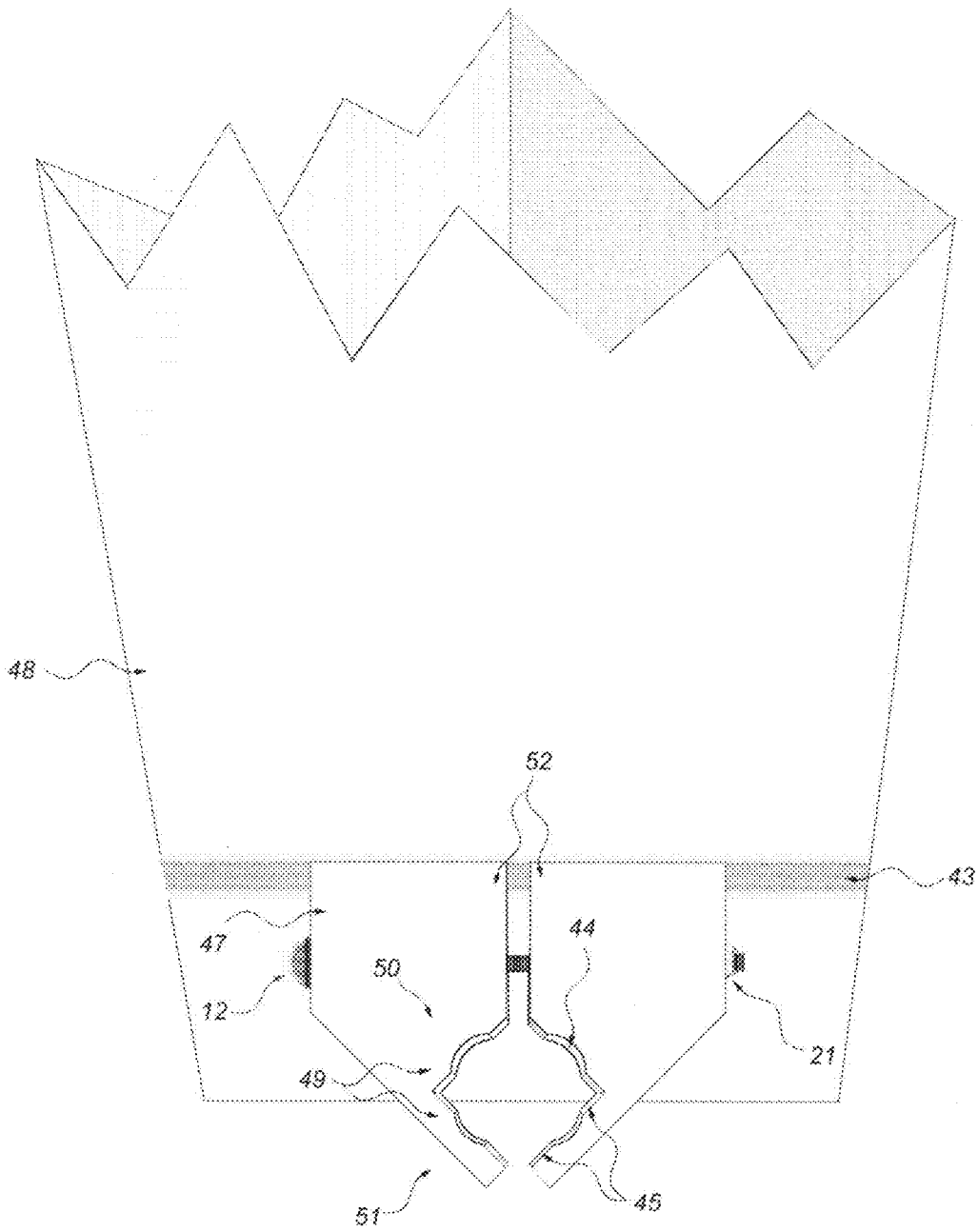
FIG. 8 is a top sectional view of the pole brace and ballasting device showing a pole clamp assembly, according to the second embodiment, secured to a triangular shaped weight container 48.

A second embodiment of pole clamp assembly 23 and pole clamp connecting form 13 of the present invention will now be described with reference to FIGS. 8 and 9. The second embodiment differs from the first embodiment in three respects. First, as shown in FIG. 8, is an alternative straight pole clamp connecting form 43 having a constant direction throughout its length positioned along one side wall of a triangular shaped weight container 48 and second pole clamp assembly 52 engaged to straight connecting form 43 according to the second embodiment. A straight pole clamp connecting form 43 allows for the utilization of a variety of weight container configurations such as the diameter wall of a container formed by a half circle. Additionally, any flat area of sufficient size and in about a vertical dimension to allow for the formation or support the attachment of a straight pole clamp connecting form 43, such as a flat protrusion on a cylinder shaped weight container, would suffice. However, a square container maximizes the weight of the ballasting load for the space occupied being more efficient as it coincides in shape to that of the tent's perimeter and thereby the preferred configuration.

Second, as seen in FIG. 8, second pole clamp assembly 52 is made up of two discrete second pole clamp blocks 47 each having a second pole clamp jaw 49 set at about a right angle bend composed of a second inner jaw 50 and second outer jaw 51. In this embodiment the second pole clamp block inner jaw 50 and second pole clamp block outer jaw 51 having an interior semicirclar round pole interface 44, positioned between a flat square pole interface 45, results in an improvement in the gripping of a round pole while still maintaining the option of gripping a square pole; it being understood the jaw configuration of the second pole clamp assembly 52 can be readily employed by pole clamp assembly 23.

Figure 9:
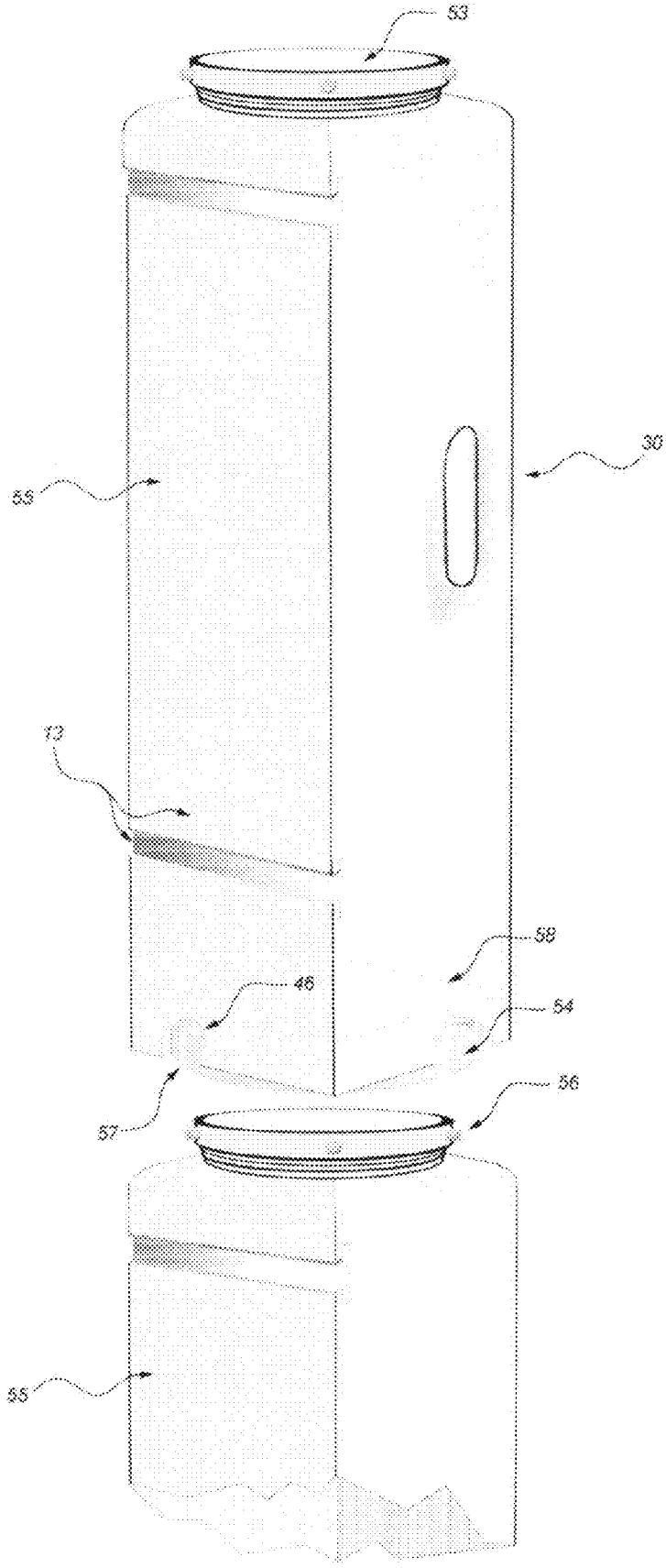
FIG. 9 is a side perspective and sectional views of the weight container 55 according to the third embodiment.

Referring now to FIG. 9, in this third embodiment weight container 55 differs from weight container 22 in that it contains a bayonet mount or bayonet connector for the joining or mating of a secondary weight container. Bayonet mount cover 53 contains a number of pins 56, or alternatively blades, and weight container 55 is adapted with a corresponding bayonet mount collar 54 disposed about its bottom wall 58. The strength of the joint is less effective than one constructed of threads for threadable mating. But it does have the advantage of speed with which a practiced user can connect the weight containers 55.

To connect a secondary weight container, cover pins 56, or alternatively blades, on the bayonet mount cover 53 are aligned with collar slots 57 on the weight container bayonet mount collar 54 and pushed together. Once the pins reach the end of the slot, the two surfaces are turned in opposite directions to guide cover pins 56 into perpendicular collar slots 46 that prevents it from being removed. The opening to the perpendicular collar slot 46 is slightly undersized and made of a resilient plastic material which holds cover pins 56 in position to prevent them from backing out. To disconnect, the user simply turns the two weight containers 55 in the opposite direction with a slight increase in force to overcome the friction of the perpendicular collar slot 46 opening, disengaging the locking turn.

The present invention has been shown and described above with the preferred embodiments and it is understood that there are numerous alternatives, modifications or substitutions which may be made which still would be within the intended spirit and scope of the invention.

I claim:

1. A pole brace and ballasting device adapted to be vertically positioned along the length of at least one pole of a tent or temporary structure having a pole, the device for bracing and holding the pole or poles, the device comprising:

[a] at least one weight container of a generally elongated hollow body for selectively receiving and discharging a dry or fluid load bearing material therein;

[b] an opening with reference to the hollow body of the weight container for selectively receiving and discharging a load bearing material;

[c] a removable cover for the weight container opening;

[d] a pole clamp disposed exteriorly of said weight container for receiving at least one pole passing through at least one said pole clamp for selectively and releasably securing said weight container along the length of a pole;

[e] a means of releasably securing said pole clamp to the weight container; and

[f] a means of releasably securing multiple discrete weight containers into a unitary assembly for repeated use.

2. A pole brace and ballasting device according to claim 1, wherein the weight container is constructed of a plastic material of adequate length having at least one flat surface of a vertical dimension and sufficiently rigid to affix to a telescoping pole or pole for the purpose of bracing the pole.

3. A pole brace and ballasting device according to claim 1, wherein at least one weight container includes a handle to be grasped by a user consisting of a cut out portion and a handle extending across the cut out portion, a handle formed by a cut out portion in the weight container, or a handle formed by a cut out in the weight container and combinations thereof.

4. A pole brace and ballasting device according to claim 1, wherein said pole clamp comprises any number of each of the following:

a right pole clamp block;

a left pole clamp block;

a common horizontally extending pole clamp block aperture therein;

a fastener adapted to extend through the aperture to releasably secure the clamp to a pole.

a pole clamp block jaw for receiving a pole;

a slip resistant surface for gripping a pole; and a pole clamp block connectable form for releasably securing to said weight container.

5. A pole brace and ballasting device according to claim 4, wherein the pole clamp block is constructed of wood.

6. A pole brace and ballasting device according to claim 4, wherein the pole clamp block is constructed of plastic or a metallic matter.

7. A pole brace and ballasting device according to claim 4, wherein at least one said pole clamp common aperture and fastener extending through the aperture each include threads for threadable mating.

8. A pole brace and ballasting device according to claim 4, wherein the fastener is a thumb screw.

9. A pole brace and ballasting device according to claim 4, wherein the jaw of said pole clamp block further comprising:

an outer jaw positioned about at a right angle to the outer jaw of its corresponding pole clamp block when in an assembled condition; and an inner jaw positioned about at a right angle to the inner jaw of its corresponding pole clamp block when in an assembled condition.

10. A pole brace and ballasting device according to claim 9, wherein the outer jaw of said pole clamp block comprises at least one fortifying fastener.

11. A pole brace and ballasting device according to claim 9, wherein the outer jaw and inner jaw of said pole clamp block each further comprises an interior semicirclar round pole interface positioned between a flat square pole interface for gripping a round pole and a square pole.

12. A pole brace and ballasting device according to claim 4, wherein said pole clamp, in an assembled condition, comprises a horizontal pole through hole forming a gripping surface in a vertical dimension relative to the direction of the pole.

13. A pole brace and ballasting device according to claim 1, wherein at least one said weight container further comprises at least one of the following:

a pole clamp connecting form for releasably securing the pole clamp to the weight container set along the perpendicular direction of a pole and having a right angle bend; or a pole clamp connecting form for releasably securing the pole clamp to the weight container set along the perpendicular direction of a pole and having a constant direction throughout its length.

14. A pole brace and ballasting device according to claim 13, wherein the weight container consists of at least one of the following:

a pole clamp connecting form molded into the weight container; or a pole clamp connecting form attached to the weight container.

15. A pole brace and ballasting device according to claim 1, wherein the means of separately and releasably securing multiple discrete weight containers into a unitary assembly comprises:

a removable cover adapted for releasably securing a secondary weight container; and a corresponding connecting interface to the cover disposed about the bottom wall of said weight container for mating to the cover.

16. A pole brace and ballasting device according to claim 15, wherein the removable cover is provided with at least one projection to facilitate the removal of the cover from a secondary weight container.

17. A pole brace and ballasting device according to claim 15, wherein the cover and corresponding connecting interface to the cover disposed about the bottom wall of said weight container are threaded for threadable mating.

18. A pole brace and ballasting device according to claim 15, wherein the cover and corresponding connecting interface to the cover disposed about the bottom wall of said weight container are adapted for bayonet mount mating.

19. A pole brace and ballasting device according to claim 15, wherein the cover and the weight container corresponding connecting interface are synchronized to allow for the automatic vertical alignment of the pole clamp connecting forms, when attaching a secondary weight container, upon reasonably reaching the rotatable limit of said weight container connecting interface.

* * * * *